US006578809B1

(12) United States Patent
Dimella

(10) Patent No.: US 6,578,809 B1
(45) Date of Patent: Jun. 17, 2003

(54) FLEX GRIP MIMPI APPARATUS

(75) Inventor: Vincent A. Dimella, 127 N. Granados St., Solana Beach, CA (US) 92075

(73) Assignees: Vincent A. Dimella, Solana Beach, CA (US); part interest; Peter J. Gluck, Mission Viejo, CA (US); part interest ( * ) Notice: Subject to any disclaimer, the term of this patent is extended or adjusted under 35 U.S.C. 154(b) by 0 days.

(21) Appl. No.: 09/706,676

(22) Filed: Nov. 3, 2000

Related U.S. Application Data

(60) Provisional application No. 60/235,144, filed on Sep. 22, 2000.

(51) Int. Cl.[7] ..... B65D 19/00
(52) U.S. Cl. ..... 248/346.11
(58) Field of Search ..... 248/346.11; 215/394

(56) References Cited

U.S. PATENT DOCUMENTS 1,683,205 A * 9/1928 Packard ..... 215/394
2,568,623 A * 9/1951 Hamm ..... 215/394
2,570,954 A * 10/1951 Kasman ..... 215/394
2,731,056 A * 1/1956 Anson ..... 16/86 A
3,013,689 A * 12/1961 Shropshire ..... 215/394
4,340,146 A * 7/1982 Stratton ..... 215/394
4,978,566 A * 12/1990 Scheurer et al. .... 248/346.11 X
5,018,695 A * 5/1991 Bishop ..... 248/346.11
5,037,025 A * 8/1991 Tonomura ..... 215/694 X
5,056,749 A * 10/1991 Ige ..... 248/346.11
5,413,302 A * 5/1995 Ferster ..... 248/346.11
5,582,321 A * 12/1996 Urbanczyk ..... 220/739
5,803,454 A * 9/1998 Adell ..... 248/346.11 X

FOREIGN PATENT DOCUMENTS

JP 6-121729 * 5/1994 ..... 248/346.11

* cited by examiner

*Primary Examiner*—Ramon O. Ramirez
(74) *Attorney, Agent, or Firm*—Patent Law Firm, P.C.; Intellepharm, Inc.; Peter Jon Gluck, Esq.

(57) ABSTRACT

A flexible grip, the right materials and a reusable and environmentally friendly molded, injected, sprayed, layered or painted coating an ultimately consumer friendly apparatus, having memory, absorbency and low cost can be offered for consideration. According to a preferred embodiment, FLEX GRIP® apparatus, system and method functions with articles including any and all beverage containers to mitigate and/or preclude undesired transmission of liquids by selectively absorbing the same in an open celled medium bordered by a waterproofed layer. In a particularly preferred embodiment dimensional sizing is featured to fixingly and matingly engage, and completely cover a bottom-portion and selected side portions of, for example, a pint glass. Likewise, environmentally-friendly aspects include use of recyclables, saving on wasted paper, and use for example, of old wetsuit material to make an industrially and economically efficient means for preventing drippage, condensate leakage, and packing issues involving impact breakage of glassware.

8 Claims, 5 Drawing Sheets

FLEX GRIP MIMPI APPARATUS

CROSS REFERENCE TO RELATED APPLICATIONS

This non-provisional utility patent application depends on a U.S. Provisional Patent Application filed under 37 C.F.R. §1.53(b)(2)", Serial No. 60/235,144, filed Sep. 22, 2000. Full Paris Convention priority is herewith expressly reserved.

BACKGROUND OF THE INVENTION

1. Field of Invention

The present invention relates generally to an improved means for preventing dripping from outer surfaces, including vessels designed to house liquids, onto other surfaces. More specifically, the present invention relates to a novel enhanced apparatus, method and system for precluding undesired leakage, dripping, or the like liquid transmissions, from the external surfaces of articles, particularly those used to house, transport and enable potable liquids to be consumed.

Commercial success has yet to be achieved for use of a supplemental absorptive strip means issuing and placed over a lower section of desired cup, in spite of the long history of failed attempts. Likewise, the instant teachings mitigate or completely control the unaddressed problem of condensate and the like dripping from drinking vessel onto users.

2. Prior Art Patents

Attention is called to the following United States Letters Patents and foreign publications, each of which has been examined and found to be inventively different than the instant teachings:

U.S. Pat. Nos. 5,425,497; 5,645,196; NL 6611523; DT 1429226;

U.S. Pat. No. 5,273,182; FR 1377535; U.S. Pat. Nos. 5,065,589; 4,681,239;

U.S. Pat. Nos. 4,540,611; 3,103,295; 5,925,466; 5,693,714;

U.S. Pat. Nos. 5,415,499; 4,948,443; 4,756,337; 2,617,549; and, U.S. Pat. No. 973,085;

during searches conducted with access to the Examiner's foreign art collection, inter alia.

U.S. Pat. No. 5,425,497 (the '497 patent) issued for the JAVA JACKET®, an insulating sleeve for hot beverage containers that shields a user's hands from the sameThe '497 patent, as in at least half of the art reviewed in conjunction with the instant filing, it relates to insulating means that circle cups. It shows that invention is still available even within the narrowed and highly patented field of art defined by the instant teachings. In contradistinction to the instant subject matter, however, the materials are not shown to include plastic or rubber based compounds.

Likewise, U.S. Pat. No. 4,681,239 (the '239 patent) issued to Roman Products on Jul. 21, 1987 showed an insulating container for liquids having an annular sealing member of resilient cellular material. The '239 patent is distinguished from the instant teachings in that it has a rim on its outer surface of an elongated annular side wall that is partially axially in register with an annular recess.

Similarly, U.S. Pat. No. 5,273,182 (the '182 patent) issued Dec. 28, 1993 for a COASTER to Laybourne. The '182 patent was targeted at applicants problem, but in lieu of providing an elegantly simple solution, disclosed mechanically questionable and over-engineered coupling devices to attempt to join an absorbent member with a multiplicity of interconnected capillary spaces.

Unlike the '182 patent, the teachings of the present invention present a variety of variations on the 'one-size fits all' theme, with no need for overly elaborate (expensive, and failure-prone) mechanical coupling add-ons.

German Offenlegungsschrift 1429226 from Feb. 6, 1969 showed a disposable Beaker cup consisting of a thin-walled plastic beaker along with a re-useable holder. This disclosure is markedly different from the instant teachings requiring at least two pieces and at least one inner ring shaped element. This teaching does show elastic deformation as its sole common element with the teachings of the present invention, which may be injected, molded cut and pasted or likewise fabricated from one unitary piece.

Likewise, Pontneau-Plastic S.A. garnered French Patent No. 1,377,535 for a goblet having a disposable attachment that may have served to limit movement as claimed in the patent, in addition to acting a coaster means for mitigating spills. Unlike the instant teachings, however, this invention included an aperture on the ventral surface and its primary function was to render the goblet immobile on a resting surface.

Two separate problems relating to the containment of cold liquids in open vessels are addressed by the teachings of this invention. The first problem is that of spillage. It is well known that a liquid in a nearly full open vessel can spill over the edges if the vessel is placed in certain positions. This is so because a liquid contained in a vessel will assume the shape of the vessel except for the upper surface of the liquid, which will assume the form of a plane parallel to the plane of the surface of the earth.

Thus, if the vessel is oriented or tipped in such a manner that it does not completely enclose the aforesaid upper surface of the liquid, the liquid will spill out of the vessel. Such tipping can occur in an instant of time, so that spillage is a common problem particularly in the use of drinking vessels such as cups, beakers, glasses and the like.

The second problem experienced by users of vessels containing cold liquids is the problem of condensation, or dew formation. As used in this discussion, the term dew includes any kind of condensation of water on a surface. Dew is a thin film of water that has condensed on surface of objects. Dew forms when cold objects cool the shallow. The term condensation refers to a change from the gaseous state of a substance to the liquid state. In the present case, the condensation occurs because the capacity of air to hold water vapor decreases as the air is cooled. The temperature at which condensation begins, for a sample of air with a given water vapor content, is termed the dew point. In general, rooms in which many people are present will have a relatively high dew point because of the high content of water vapor in exhaled breath. Likewise, outdoors on a warm day on which cold drinks are particularly desirable, the dew point will be relatively high.

From this brief discussion it will be clear that both the problems of spillage and dew formation as discussed above can be ameliorated in related ways. Small amounts of liquid that are spilled over the rim of a vessel, and small amounts of dew can be absorbed by a suitable medium. This absorption occurs by several physical processes, including capillary action and adsorption. These processes can be explained by considering the effects of two opposing forces: adhesion, the attractive force between the molecules of fluid and the material, and cohesion, the attractive force between the molecules of the fluid. Thus, provision of a suitable structure and medium for absorbing spillage and dew is one mechanism underlying the teachings of this invention.

In addition, on the basis of the mechanism of dew formation on the surface of a vessel containing a cold liquid described above, dew formation can be inhibited by insulation means for decreasing the transfer of heat to the vessel surface from the layer Of overlying air in contact with that surface.

What has been discovered is that in combining a flexible grip, the right materials and a reusable and environmentally friendly molded, injected, sprayed, layered or painted coating an ultimately consumer friendly apparatus, having memory, absorbency and low cost can be offered for consideration.

Attention is called first to traditional or conventional 'coasters' or generally planar objects designed to shield a piece of furniture's surface from the bottom of a drinking cup. Unlike the instant teachings, such devices do not protect other crucial surfaces (such as a user's clothing, for example) from those undesired aliquots escaping, for example, from a cup.

The COZIES® brand of beverage cooler (San Diego County, Calif.), has not been found to include solid ventral surfaces, in contradistinction to the instant teachings. Beverage insulators generally focus on covering the majority of the surface area of a bottle or can—where the majority of the heat would be transferred. No attention to the bottom portion is shown in such disclosures, nor is it suggested how or why the same could be relevant to such design at a technical level.

In short, despite the numerous attempts to innovate within this area, as shown by the many patents asserted to be related to these ideas, a longstanding need to protect both precious surfaces and users' clothing from the ravages of dripping liquids remains ineffectively addressed prior to the advent of the instant teachings. U.S. Letters Patent references offered herein for consideration, but not distinguished in detail merely define the state of the art or show the type of systems which have been used to alternately address those issues ameliorated by the teachings of the present invention. Accordingly, further discussions of these references has been omitted at this time due to the fact that they are readily distinguishable from the instant teachings to one of skill in the art.

SUMMARY OF THE PRESENT INVENTION

The present invention is for a selectively absorbent apparatus that is attached to another device and absorbs undesired liquid. According to a particularly preferred embodiment, the other device is a drinking vessel and the teachings of the present invention comprise a flexible assembly form fitted to the bottom of the vessel, which stops condensation from, for example, drinking glasses from dripping onto any undesired surface, including liquid and oil sensitive surfaces and the clothing of a user.

The apparatus of the invention is advantageously constructed of foamed plastic, wherein said foamed plastic is a synthetic resin converted into a flexible sponge-like mass with an open-cell structure. Under known appropriate conditions, certain thermosetting or thermoplastic resin can be converted into a flexible sponge-like foam. Such plastics include, vinyls, polyethylene, silicones, cellulose acetate, and urethanes. Appropriate conditions for producing open cell plastics comprise incorporating an inert gas into the resin under pressure and then releasing the mixture to atmospheric pressure, followed by curing the resultant foam.

Alternatively, the apparatus of the invention may be made of foam rubber, also called sponge rubber or latex foam, wherein said foam rubber is a flexible, porous substance made from a natural or synthetic latex compounded with various well known ingredients and whipped into a foam. The resulting product contains roughly about 85 percent air and 15 percent rubber and can be molded and vulcanized.

Alternatively, the apparatus of the invention may be made of a member selected from the group known as sanitary papers or sanitary grades, whereby a disposable product is produced. Sanitary papers include paper toweling of various thicknesses and are made from various proportions of sulfite and bleached kraft pulps with relatively little refining of the stock to preserve a soft, bulky absorbent sheet which may be creped. Because of the bulky texture of sanitary papers, the paper is advantageously treated with resins to provide an embodiment of the invention with a smooth, printable outer surface having a highly absorbent core and good thermal insulating properties.

Briefly stated, FLEX GRIP mimpi apparatus, system and method functions with articles including any and all beverage containers to mitigate and/or preclude undesired transmission of liquids by selectively absorbing the same in an open celled medium bordered by a waterproofed layer. In a particularly preferred embodiment dimensional sizing is featured to lockingly or matingly engage, and completely cover a bottom portion and selected side portions of, for example, a pint glass. Likewise, environmentally-friendly aspects include use of recyclables, saving on wasted-paper, and use for example, of old wetsuit material to make an industrially and economically efficient means for preventing drippage, condensate and the like liquid based insults to clothes and surface materials.

According to a most preferred embodiment in a strip of material issuing from and encircling a bottom peripheral aspect of another member to prevent dripping therefrom, the improvement comprising, in combination, a means for absorbing liquid; memory means for maintaining at least about a predetermined diameter; and a display means for receiving desired images.

According to a preferred embodiment, FLEX GRIP mimpi comprising an open-celled material surrounds a region adjacent to and the bottom portion of any article including a vessel holding liquid and fittingly engages with such bottom portion to absorb both minor over-spillings and any condensate being pulled toward a user by gravity from the outer surface of the vessel.

According to a feature of the present invention there is provided FLEX GRIP mimpi apparatus comprising, in combination; a flexible variably absorbent saucer means for completely surrounding and fittingly engaging a bottom region of a vessel, having at least an inner and an outer surface, dimensioned to matingly engage the vessel, whereby a substantially planar angle is maintained with a resting surface when the apparatus is emplaced and disposed in predetermined special orientation relative to the vessel.

According to another feature of the present invention thereis provided A system for preventing undesired dripping and spilling, comprising; a preformed cupping means for engaging a predetermined vessel's bottom portion whereby an angle at the central axis of the vessel is maintained in substantially orthogonal relationship to a desired plane upon which the vessel is disposed.

According to yet still another feature of the present invention there is provided, a method for preventing undesired transmission of liquids, comprising the steps of; providing an absorbent female means having a coated outer surface for matingly engaging a ventral surface and selected portions defining an adjacent peripheral zone of an article permitting said absorbent female means to selectively absorb liquid; and selectively removing, rinsing or washing and replacing said absorbent female means, as needed.

According to yet still another aspect of the invention there is provided a process for creating FLEX GRIP apparatus by selecting a portion of neoprene material having an outer waterproofed coating, parsing said neoprene into at least two sub-units, joining the at least two subunits with a means for adhesing selected from the group consisting of cementing, velcro-ed closure, annealing and the like joinder systems.

The above described and many other features and attendant advantages of the present invention will become apparent by reference to the following detailed description when considered in conjunction with the accompanying drawings, in which related reference designators bare common, or identical numbers.

BRIEF DESCRIPTION OF THE DRAWINGS

Detailed descriptions of preferred embodiments of the invention will be made with reference to the accompanying drawings, in which like reference designators represent common elements, mindful that multiple alternate embodiments of the present invention are both illustrated and contemplated.

DETAILED DESCRIPTION OF THE PREFERRED EMBODIMENTS

Figure 1:
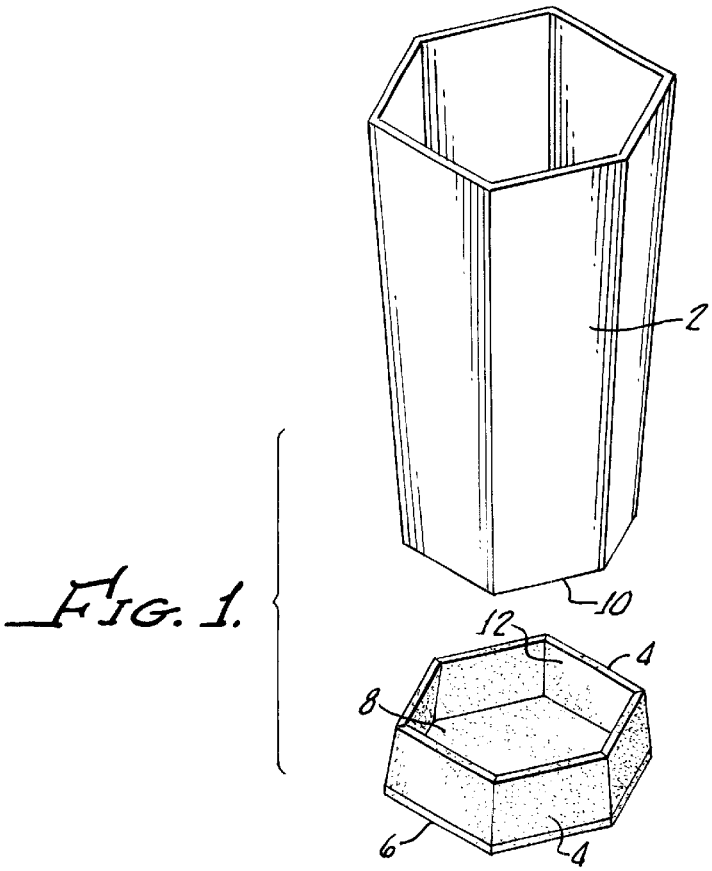
FIG. 1 is a schematic of partial perspective view of a generalized conception of one embodiment of the device, according to the teachings of the present invention.

The physics of water creates untoward challenges which impinge upon many of the conveniences that have been developed in modern society. Following myriads of testing situations, the present inventor has discovered that he can prevent most condensation aliquots from being driven by gravity onto a user's clothes and any number of given surfaces functioning as 'tables'. This is crucially important given the possible damage to surface which are not designed to receive water, such as certain finished or unfinished woods, types of high-end tiles, and further includes all of those articles objects, papers and the like which may be damaged or destroyed through contact with liquids at all.

Likewise the instant invention prevents the generalized dripping of liquid on clothing that occurs constantly for those using most known drinking glassware. A virtually unquantifiable number of liquids mark and/or stain (and render of lesser value table and desk-top surfaces and objects such as papers disposed thereupon) or otherwise permanently or temporarily mar the clothing of those who drink liquids, in for example, restaurants, bars and gambling establishments. Likewise, even those drinking at work or at home readily endanger surfaces not amenable to liquid which may be stained, marked, or otherwise soiled. The damages to property, clothing and reputations are particularly pronounced in regions where condensate readily forms, and they are further crucial where lighter color fabric and materials are common, necessary of otherwise used.

Since condensation of liquid occurs whenever either gas changes to liquid, or when water-based (compounds, mixtures, admixtures, combinations, drinks, potions) liquids are formed directly by catabolic or anabolic changes—a serious issues arises with glassine and plastic drinking vessels. This is because these reactions are temperature driven, and most users prefer to have their drinks decanted into vessels at temperatures different then the vessels themselves, or there are other protocol-based or aesthetic-based reasons, in addition to the individuated and personalized or subjective bases involved.

Each time that someone is served from a container of liquid stored or designed to be stored at a temperature different from the vessel, there is the potential for the generation and gravity-based travel of condensate. Likewise, when a glass, for example, is placed on a surface by a human, unless perfect placement is achieved, minor amounts of the liquid are spilled, and offensive noise (for example the 'clanking' of glasses). Each of these problems is both addressed and ameliorated by the advent of the instant teachings.

Similarly, the inherent stability provided by a cushioned means for matingly engaging the bottom of a glass in and of itself mitigates the volume of aliquots which escape 'over the top' of drinking vessels. By being both price efficient, washable and recyclable, the present invention necessarily has a positive impact on environmental concerns and issues by precluding the wasting of other materials, as discussed below.

Environmental issues likewise abound when the number of napkins, paper towels and the like disposable paper-based products consumed daily are factored in. With the teachings of the present invention these can be overcome. Table's stains can be prevented without coasters.

Sanitary concerns in public places are also addressed by the instant teachings (fewer germs are spread), as can noise reduction (no more 'clanking of glasses' on bar tops, marble or glassine surface) and shipping of glasses. Since 'chipped edges' are a major concern of those transporting glassware, a 'cover' or shielding means for the bottom of a glass stacked in a packing crate on its head, that is inexpensive and flexible, ostensively mitigated and/or prevents impact based injury.

Similarly child-proofing, slipping, and shipping problems are also ameliorated by the instant teachings, as will become clear to those having a modicum of skill in the art, according to the claims of the present invention.

Turning attention now to FIGS. 1–3, and 8–9 there is shown further detail concerning prototypes of preferred embodiments of the present invention which have been made and put into practice to date. Likewise, in addition to the illustrated embodiments, use of the instant teachings as handle coverings for pliers, wrenches and the like tools and change holders are contemplated.

FIG. 1 shows a schematized article, in this case avessel for housing liquids at 2. Vessel 2 is generally glassine, plastic based, or crafted from a marginally pliable or stiffened material (as defined by its respective Young's Modulus) such that it can support-the weight of a volume of liquid disposed therein.

Bottom surface 10, of vessel 2 is completely covered by FLEX GRIP apparatus 4, whereby inner surface 8, abuts bottom surface 10. Inner wall 12 fittingly embraces the outer surface of vessel 2's bottom region, whereby transmission of liquid therethrough is precluded.

FLEX GRIP apparatus 4 is composed of any number of flexible materials, including neoprene (Billabong USA, Los Angeles County, Calif.), sponge foam, conventional plastics, known rubbers, PTFE compounds made from any of the same, urethanes, polysiloxanes, and the like synthetics and the like unknown materials which share the characteristic of having an open-celled aspect, and a waterproofed aspect (imperviousness to liquids).

Facultative fin or stabilizer 6 provide the ability to stand on a substantially level surface, and is optional within the context of the instant teachings. However, it may be extended, textured, shortened, stiffened or otherwise customized for enhanced stability, for example when travel is within the car of a train, a boat or an airplane, or any other surface wherein a substantially planar surface is subject to vertical or transverse forces.

Figure 2A:
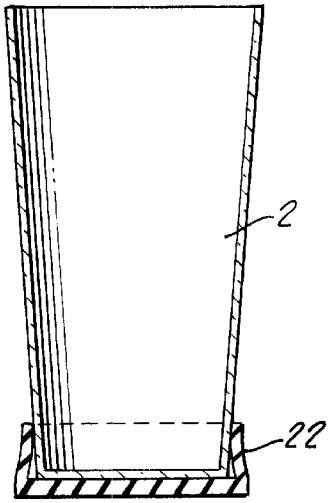
FIG. 2 is an embodiment used with a conventional pint glass and an additional view of the instant teachings as shown in one embodiment of the device, according to the teachings of the present invention.
Figure 2B:
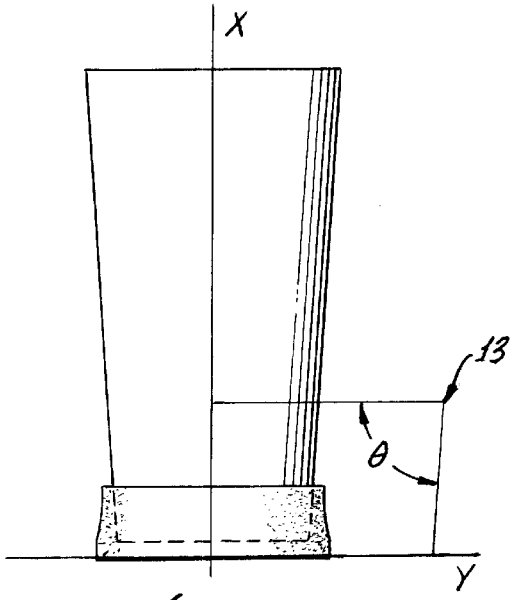
Figure 4:
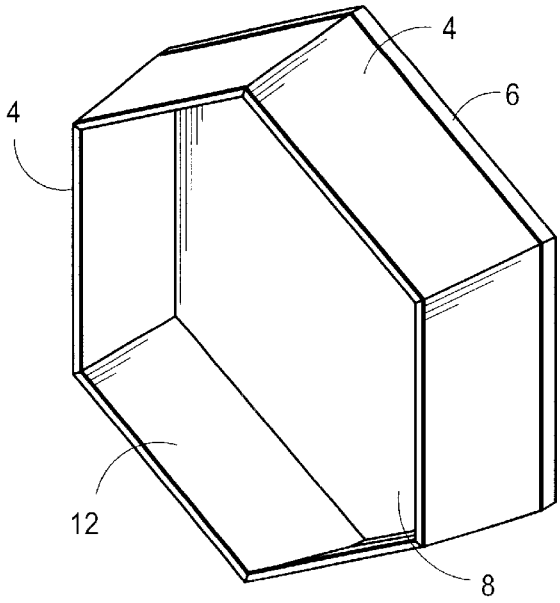
FIG. 4 is a view of an alternate embodiment of the apparatus shown in FIG. 1.

Referring now to FIG. 2, the article/workpiece/vessel 2 is a conventional pint glass, such as used to hold any number of drinks from beer to water. FLEX GRIP apparatus 22 is shown in an attached posture relative to vessel 2, whereby FLEX GRIP apparatus 22 matingly engages a bottom portion of vessel 2, and remains attached to the same when vessel 2 is lifted (for example, by a user to take a drink).

Likewise, when vessel 2, bracingly engaged to FLEX GRIP apparatus 22 is replaced on a substantially planar surface (as indicated by ordinate y) the entire assembly is maintained in a substantially orthogonal angle theta 13, relative to the substantially planar surface.

FLEX GRIP apparatus 22 may be a unitary neoprene construction, may be EVA, or any number of related plastic or rubberized petroleum distillate products. Similarly, depending on the porosity of the material, those skilled in the art may substitute inherently similar materials.

Likewise, FLEX GRIP apparatus 22 may be composed of a plurality of strips of mill ends, remnants, or 'scraps' of, for example, neoprene, with or without an outer coating layer that is waterproofed. Conventional 5 mm wetsuit material has been used, with the outermost waterproofed coating layer, and comprises a preferred embodiment of the instant teachings.

The present inventor has discovered that salvage value of 'used' wetsuits may be enhanced by parsing the same and rejoining at least two, or as many as several pieces, using standardized cementing material (BLOCK/SURF of Chatsworth, Calif.).

FLEX GRIP apparatus 22 in this way serves at least three important functions for the preservation of the environment. First, it prevents waste of natural resources by recycling used articles having appropriate plastic or rubber characteristics (including wetsuits, tires, etc . . . ) and second it prevents the needless waste of paper-based supplies like napkins, paper towels, cardboard coasters, and third it obviates the need for dry-cleaning which saves precious resources and likewise stops the dumping of noxious chemicals into drains and thus into the water table.

Rubbers, plastics and the like materials may be sprayed on, melted, cured, baked, laser trimmed and otherwise subject to manipulations based upon desired porosity and 'hand'. Owing to the memory of such materials, minimization of the size and shape of FLEX GRIP apparatus 22 is further contemplated based upon the particular application as issue. By way of further example, FLEX GRIP apparatus 22 is further composed of translucent or transparent open-celled material and has been crafted with an extremely low profile for use with wine glasses, snifters for brandy and the like stem-using vessels.

Likewise, surface characteristics according to the instant teachings are malleable and may be tailored to be hardened, clear, subject to logos being disposed therein, mounted thereupon, embossed, engraved, electronically displayed and the like.

Referring now to FIGS. 3–9 it will be appreciated how the dimensional variation encompassed by the instant teachings allows the present invention to be varied to fit all known beverage containers.

Figure 3A:
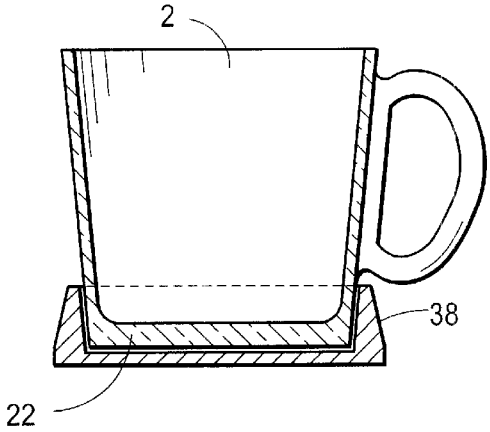
FIG. 3 is an embodiment used with a conventional coffee cup and an additional view of the instant teachings as shown in one embodiment of the device, according to the teachings of the present invention.
Figure 3B:
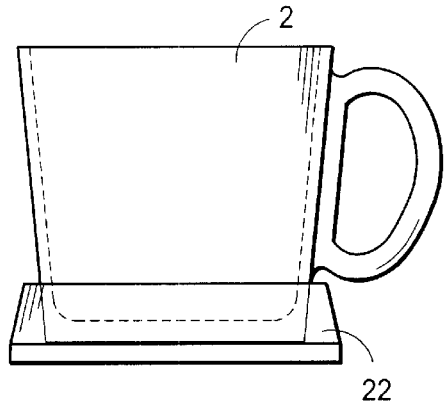
Figure 5A:
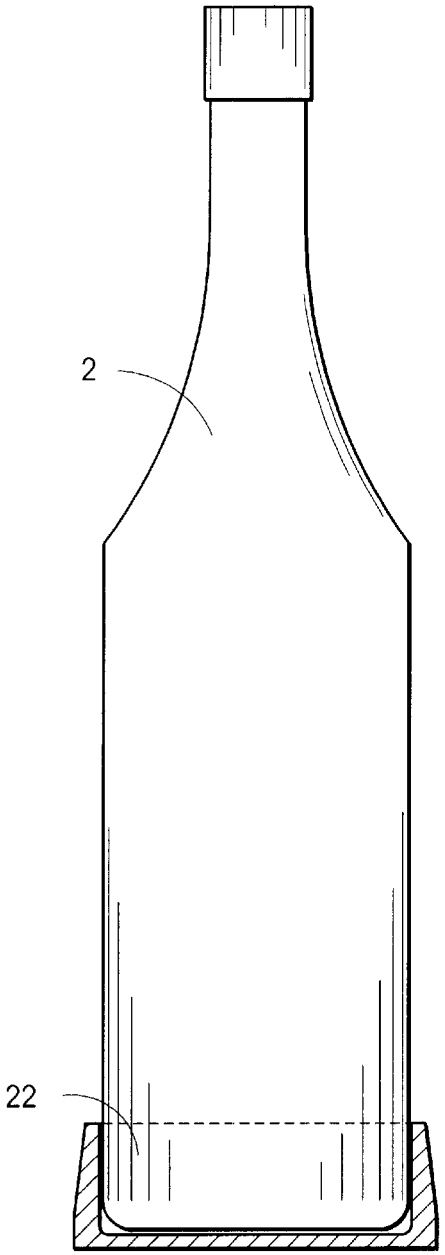
FIG. 5A is a schematic view of an embodiment used with a conventional wine bottle.
Figure 5B:
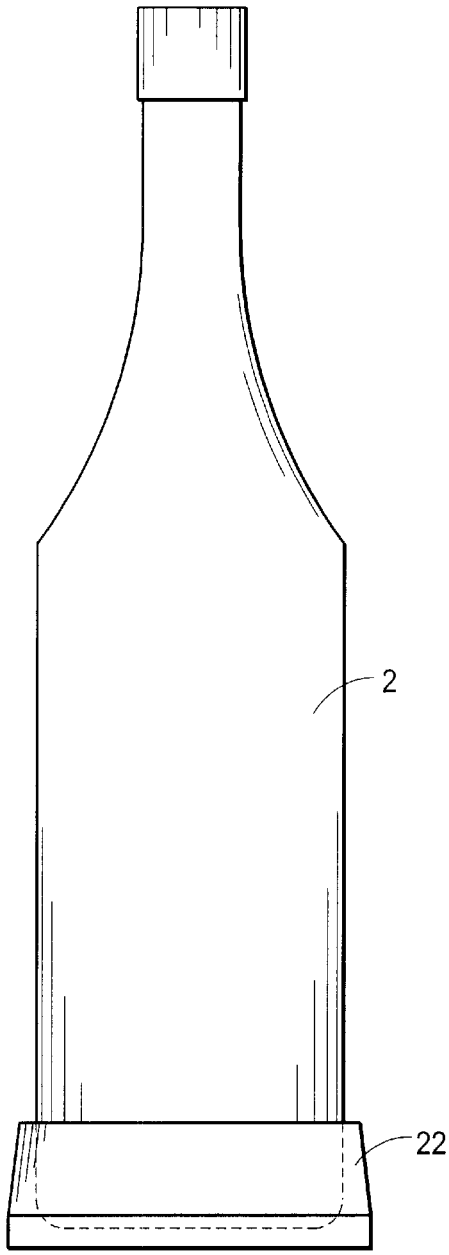
FIG. 5B is a view of the instant teachings as shown in one embodiment of the device, according to the teachings of the present invention.
Figure 6:
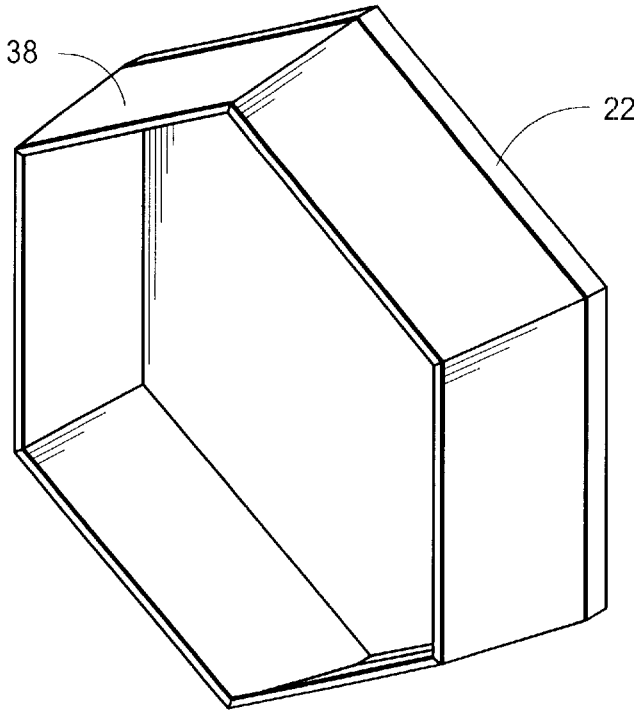
FIG. 6 shows a rotated view of an embodiment shown in FIG. 1, and various related views are included throughout to show universal sizing and planar orientations according to the teachings of the present invention.
Figure 7A:
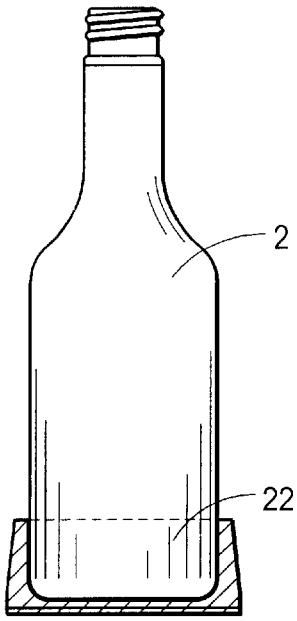
FIG. 7A shows an embodiment used with a conventional glass bottle.
Figure 7B:
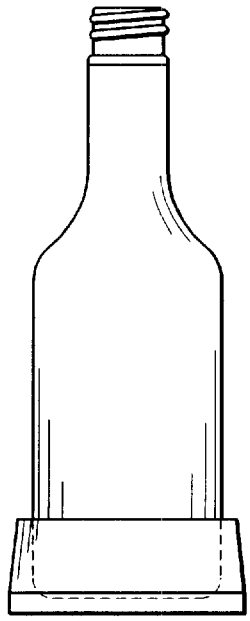
FIG. 7B shows a view of the instant teachings as shown in an embodiment of the device, according to the teachings of the present invention.
Figure 8:
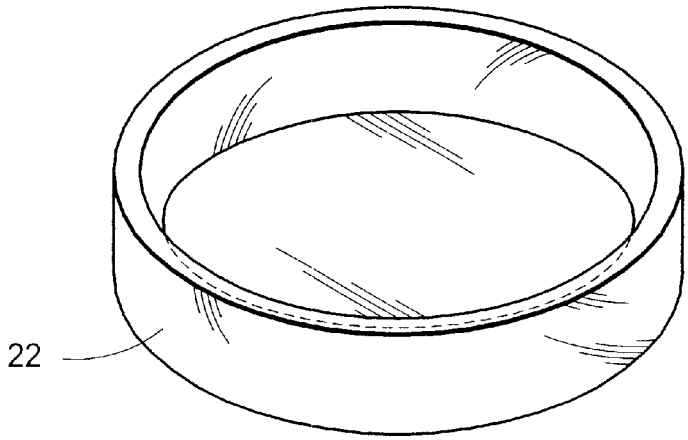
FIG. 8 is another alternate embodiment crafted from a used piece of neoprene, effective for use with any conventional 'pint' glass; and, FIG. 9 is yet another alternate preferred embodiment wherein a substantially translucent material and a logo display zone complement the teachings of the present invention.
Figure 9:
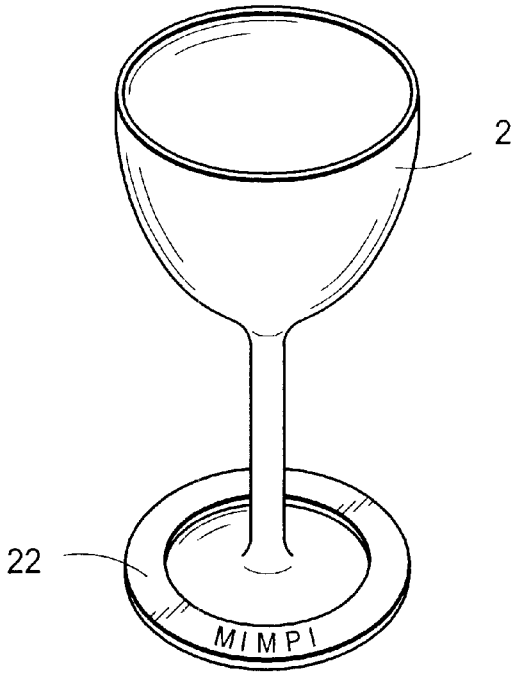

FIGS. 3 and 8–9 each shows pre-formed cupping means 22, housing a conventional coffee cup 2. It is noted that according to this embodiment, pre-formed cupping means 22, further comprises peripheral/outer layer 38. As discussed above and described below, the nature of the materials as absorbent functions in complementary fashion with the waterproofed nature of at least on aspect of the same.

For example, according to an embodiment with outer layer 38, the surface may be a smoothed and sheened rubberized coating, over principal body 22 of neoprene. As discussed, for example, since the salvage value of 'used' wetsuits may be enhanced by parsing the same and rejoining at least two, or as many as several pieces, using standardized cementing material (BLOCK/SURF of Chatsworth, Calif.), FIG. 3 can include either originally reclaimed wetsuit material (at any known thickness, for example, 5 mm in this model) or the same enhanced by melting, gluing, embossing or adhesion of other surface modalities, elements, pieces, finishing or adhesions.

Since outer layer 38 is waterproofed, when condensation forms on vessel 2, it is pulled downward by gravity until lodged in absorbent layer(s) 22 and then held in by outer layer 38. Those having a modicum of skill will readily apply the instant teachings to bottles, cans, wine glasses, pint glasses, alternately shaped vessels, plastic cups, child-proof cups, pitchers and the like.

Likewise it is known that those of skill can understand readily the remaining figures and further understand the many and varied industrial, chemical, laboratory based usages of the instant teachings. For example, incorporation of a neutralizing agent, or the like chemical equilibration means in the open-celled portion when dealing with acids or the like specialty chemicals.

Similarly, incorporation of additional elements, such as a girth, or cinching means for tightening around the desired diameter is incorporated within the instant teachings. Such devices allow for on-site custom fitting or variations of the 'one-side fits all' versions of the present invention and are clearly contemplated by the scope of the instant teachings.

Referring now specifically only to FIG. 8 and FIG. 9, there are shown two particularly preferred embodiments, substantially flexible jacket 22 having at least an inner surface and an outer surface, wherein said jacket is adapted to fittingly cover and cuppingly engage an area comprising substantially the entire bottom and a predetermined portion of the lower sides of a vessel for containing a liquid below ambient temperature, wherein said jacket is constructed of material that impedes heat transfer from said outer surface to said liquid, and wherein said jacket is capable of absorbing said liquid.

Those having a modicum of skill in the art understand that this can be either a plastic based or paper based assembly, and the present invention likewise includes a kit for sales, comprising substantially flexible jacket 22 having at least an inner surface and an outer surface, packaging materials and, at least one instructional device for explaining the use of said device. For example, used pieces or recycled pieces of wetsuits and recycled paper products can be offered for users to assemble their own FLEX® GRIP mimpi apparatus.

Likewise, in FIG. 9 a translucent or transparent version 22 is shown having an embossed, tattooed, engraved, stickered, pressed, melted, scored or otherwise emplaced logo ["MIMPI"] disposed whererby a users can view the same.

Although the present invention has been described in terms of the preferred embodiments above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

What is claimed is:

1. A device to mitigate dripping from a vessel, said device comprising:

a single strip of elastic deformable absorbing material shaped as a low profile round cup;

said cup having inner and outer surfaces defining a substantially flat bottom portion continuous with sides extending therefrom, and being elastically deformable to snugly engage the contours of the vessel.

2. The device recited in claim 1, wherein the strip of material is constructed of two pieces of identical material bonded together by glue.

3. The device recited in claim 1, wherein the strip of material is neoprene.

4. A device to mitigate dripping from a vessel, said device comprising:

a cup shaped unitary strip of absorbent material having an open upper end, a closed lower end and cylindrical side walls disposed between the ends;

whereby the device is undersized slightly relative to the vessel, and capable of being stretched to fit around and snugly engage the contours of the vessel without exceeding the plastic limit of the device.

5. The device recited in claim 4, wherein the strip is constructed of two pieces of identical material bonded together.

6. The device recited in claim 4, wherein the strip of material is recyclable.

7. The device of claim 4, wherein the strip comprises two different types of material.

8. An article of manufacture, comprising, in combination:

a low profile cup shaped coaster means for deformably conforming to the contours of a vessel, made up of a single strip;

the means stretches from a first unconformed position to a second conformed position when placed on the bottom of the vessel;

whereby said means further comprises inner and outer surfaces defining a substantially flat bottom portion connected to side walls extending therefrom; and, whereby the vessel is maintained in substantially orthogonal relationship to a planar surface upon which it rests, when said article is in the second conformed position on the bottom of said vessel.

* * * * *